US012065226B1

(12) United States Patent
Lanni

(10) Patent No.: US 12,065,226 B1
(45) Date of Patent: Aug. 20, 2024

(54) FIXED-PITCH BOLTED PROPELLER

(71) Applicant: Rolls-Royce Marine North America Inc., Walpole, MA (US)

(72) Inventor: Francesco Lanni, Walpole, MA (US)

(73) Assignee: Rolls-Royce Marine North America Inc., Walpole, MA (US)

( * ) Notice: Subject to any disclaimer, the term of this patent is extended or adjusted under 35 U.S.C. 154(b) by 0 days.

(21) Appl. No.: 18/143,794

(22) Filed: May 5, 2023

(51) Int. Cl.
*B63H 1/14* (2006.01)
*B63H 1/20* (2006.01)

(52) U.S. Cl.
CPC ..... *B63H 1/20* (2013.01); *B63H 1/14* (2013.01)

(58) Field of Classification Search
CPC .. B63H 1/14; B63H 1/20; F04D 29/34; F01D 5/025
See application file for complete search history.

(56) References Cited

U.S. PATENT DOCUMENTS 3,255,827 A * 6/1966 Nichols ..... B63H 3/002 417/61
3,448,715 A * 6/1969 Wray ..... B63H 23/321 416/86
3,557,744 A * 1/1971 Herbert ..... B63B 3/40 114/57
3,711,220 A * 1/1973 Ramback ..... B63H 3/12 416/207
3,794,441 A * 2/1974 Johnson ..... B63H 3/04 416/167
6,537,031 B1 3/2003 Bacskay
7,144,222 B2 12/2006 Lanni et al.
8,235,669 B2 * 8/2012 Des Roches ..... F03B 3/126 416/219 R
2011/0200433 A1 8/2011 Forsstrom
2014/0140823 A1 * 5/2014 Krotzer, Jr. ..... F01D 25/162 415/170.1

(Continued)

FOREIGN PATENT DOCUMENTS

CN 106347612 A * 1/2017

OTHER PUBLICATIONS

"Adjustable bolted propeller, ABP," data sheet, Kongsberg Maritime, http://www.kongsberg.com, Oct. 14, 2009, pp. 1-2.

(Continued)

*Primary Examiner* — David E Sosnowski
*Assistant Examiner* — Theodore C Ribadeneyra
(74) *Attorney, Agent, or Firm* — Barnes & Thornburg LLP

(57) ABSTRACT

A fixed-pitch bolted propeller includes: a hollow hub body configured for attachment to a rotatable shaft, where the hollow hub body includes connection ports circumferentially distributed on an outer surface thereof; propeller blades, where each of the propeller blades terminates in a blade flange attached to the outer surface of the hollow hub body at one of the connection ports; retention plates positioned on an inner surface of the hollow hub body adjacent to the connection ports, where the retention plates include threaded recesses; and bolts extending through bolt holes in the blade flanges and the connection ports and into the threaded recesses of the retention plates to secure the propeller blades to the hollow hub body. The retention plates and the bolts each comprise a material having a tensile strength of at least about 125 ksi and/or a fatigue endurance limit of at least about 50 ksi.

22 Claims, 7 Drawing Sheets

(56) References Cited

U.S. PATENT DOCUMENTS

| | | | | |
|---|---|---|---|---|
| 2016/0251737 | A1* | 9/2016 | Majka | C21D 8/005 148/605 |
| 2017/0267339 | A1* | 9/2017 | Bergeson | B64C 27/48 |
| 2022/0123613 | A1* | 4/2022 | Vermeulen | H02K 1/28 |

OTHER PUBLICATIONS

"Built-UP Propellers enable uninterrupted vessel service due to underwater blade (de)mounting," Wärtsilä Built-Up Propellers (BUP), http://www.wartsila.com, retrieved Jan. 2023, pp. 1-4.

"Fixed Pitch Propellers, FPP Type," product literature excerpt, Fincantieri Marine Systems, http://fincantierimarinesystems.com, Mar. 2019, 1 p.

* cited by examiner

FIXED-PITCH BOLTED PROPELLER

TECHNICAL FIELD

This disclosure relates to propeller design and, in particular, to a fixed-pitch bolted propeller for naval applications.

BACKGROUND

Propellers are an integral component of naval propulsion systems. Examples of propeller designs include controllable pitch propellers (CPPs), fixed pitch propellers (FPPs), fixed bolted propellers (FBPs) and adjustable bolted propellers (ABP). FBPs, which have a fixed pitch, are built-up from multiple components and bolted together. The primary challenge for a built-up propeller is to secure the blades robustly to the hub with bolting such that the materials associated with the blades, bolts, and hub have sufficient structural integrity. Typical fixed-pitch propellers with bolt-on blades utilize high strength bolts that are threaded into the blade or the hub body. The blade and hub body are typically made of much lower strength material than the bolts, resulting in the need for many and/or larger bolts to ensure that the shear strength of the threads in the hub or the blade are within allowable static and fatigue limits.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Described in this disclosure is a fixed-pitch bolted propeller (or fixed bolted propeller; FBP) that avoids disadvantages of existing designs while preserving the benefits of bolted-on blades and ensuring that high power density requirements can be met.

Figure 1A:
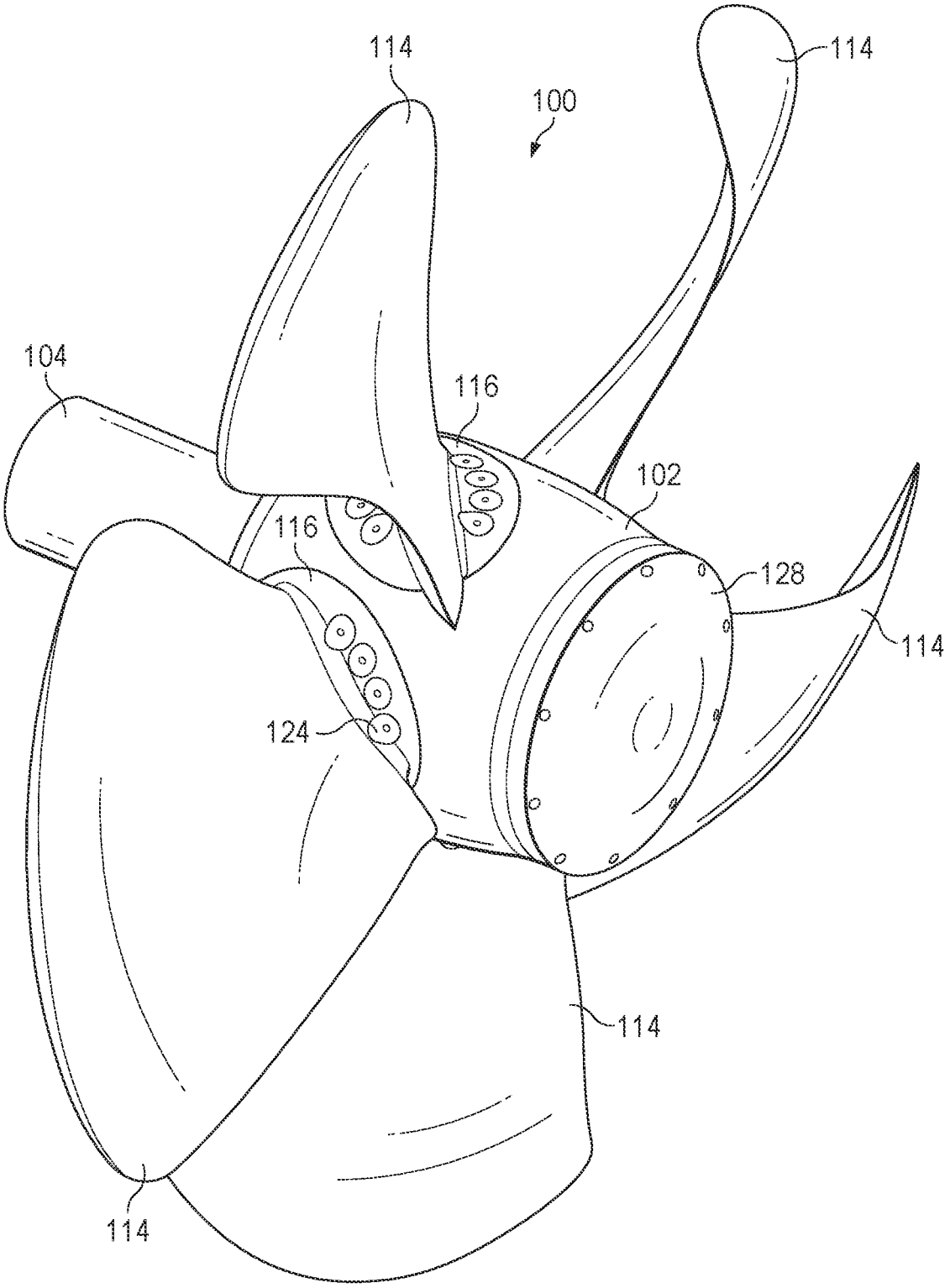
FIG. 1A is a perspective view of an exemplary fixed-pitch bolted propeller attached to a rotatable shaft.
Figure 1B:
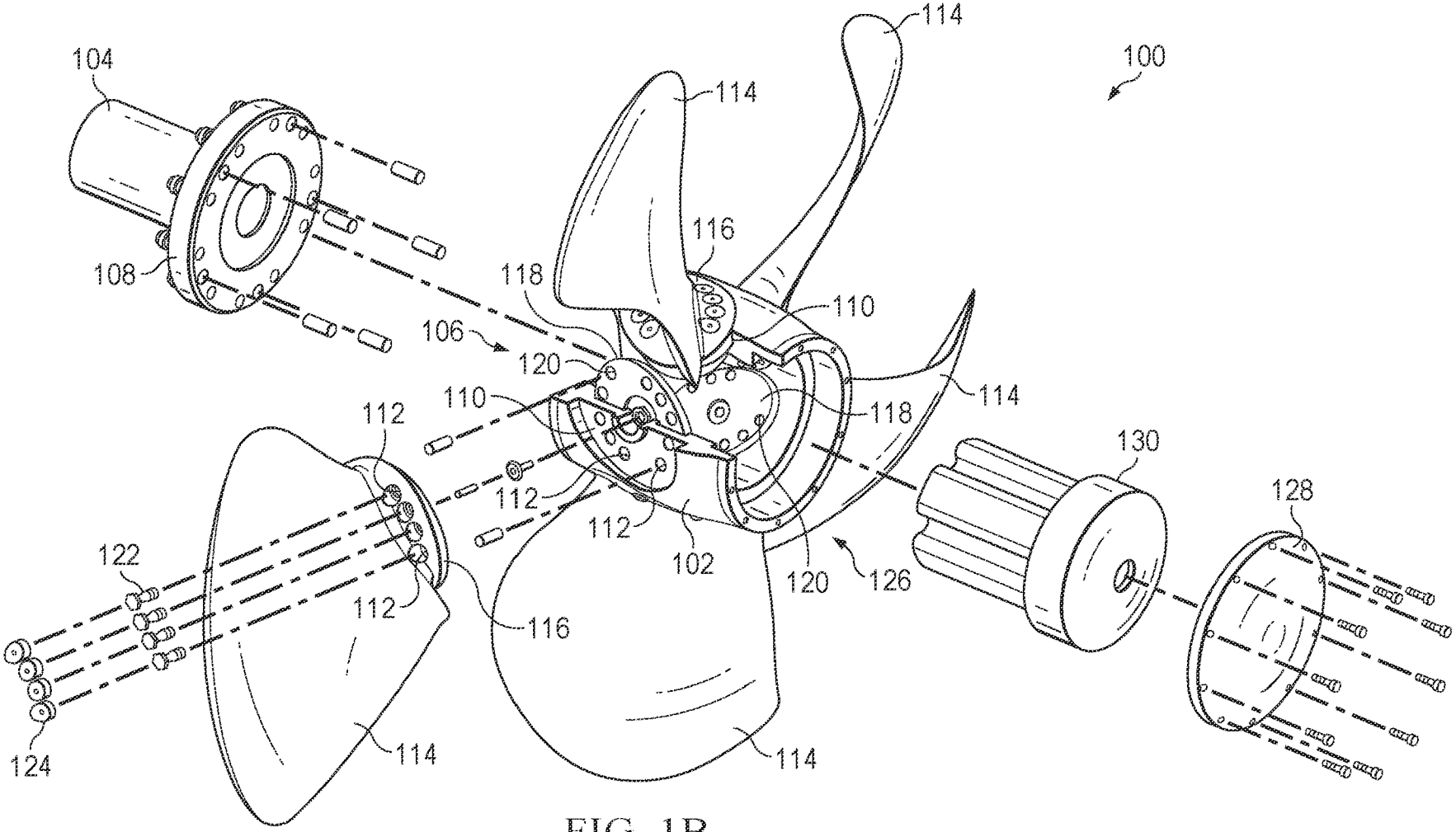
FIG. 1B is an exploded view of the fixed-pitch bolted propeller of FIG. 1A, where retention plates are visible within the hollow hub body ("hub").
Figure 2A:
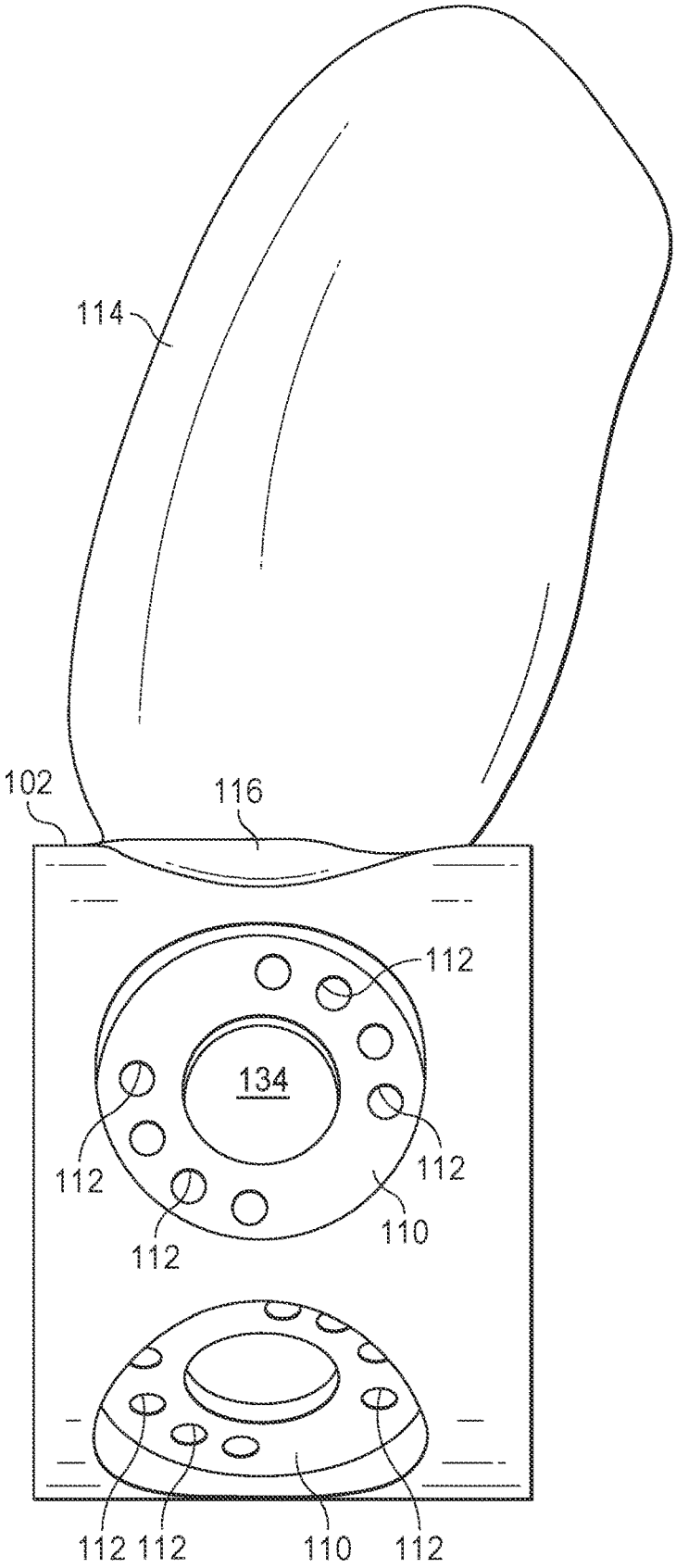
FIG. 2A shows a side view of a portion of the hub of the fixed-pitch bolted propeller.

FIGS. 1A and 1B show a perspective view and exploded view of the fixed bolted propeller 100, which includes a hollow hub body (or "hub") 102 and propeller blades 114 circumferentially positioned about the hub 102. The hub 102 is configured for attachment to a rotatable shaft 104 and includes connection ports 110 circumferentially distributed on an outer surface thereof for attachment to the propeller blades 114. Referring to FIG. 2A, each of the connection ports 110 includes bolt holes 112 that enable the hollow hub body 102 to be secured to the propeller blades 114. The bolt holes 112 may be configured to receive bolts and/or dowels.

As shown in FIGS. 1A and 1B, each of the propeller blades 114 terminates in a blade flange 116 attached to the outer surface of the hollow hub body 102 at one of the connection ports 110. To facilitate attachment of the propeller blades 114 to the hub, the blade flanges 116 include bolt holes 112 which are aligned with the bolt holes 112 of the connection ports 110. Five propeller blades 114 are shown in the figures; however, generally speaking, the fixed bolted propeller 100 may include from three to six propeller blades 114, and consequently from three to six connection ports 110. The hollow hub body 102 may have a flanged first end 106 that can be attached to a flanged end 108 of the rotatable shaft 104 for use, for example, in a naval propulsion system. The fixed bolted propeller 100 may further comprise a hub end cover 128 secured to a flanged second end 126 of the hollow hub body 102.

The fixed bolted propeller 100 further includes retention plates 118 positioned on an inner surface of the hollow hub body 102 adjacent to the connection ports 110, as shown in FIG. 1B. The retention plates 118 include threaded recesses 120 configured to receive bolts 122 extending from outside the hub and through the bolt holes 112 of the blade flanges 116 and connection ports 110 to secure the propeller blades 114 to the hub 102. The threaded recesses 120 may extend partially or completely through the thickness of the retention plates 118, where, in the latter case, they may alternatively be referred to as threaded holes 120. The retention plates 118 and the bolts 122 each comprise a material having a tensile strength of at least about 125 ksi (or at least about 862 MPa) and/or a fatigue endurance limit of at least about 50 ksi (or at least about 345 MPa). An inner surface of the hollow hub body 102 adjacent to each of the connection ports 110 (where the blades 114 attach) may have a flat or substantially flat surface configured for placement of the retention plates 118, as illustrated in FIG. 2C. The blade flanges 116 and retention plates 118 may also include piloting diameter features to interface with a centralized hole 134 which may be present in each of the connection ports 110.

Use of the high-strength retention plates 118 in conjunction with high-strength bolts 122 avoids a configuration where the high-strength bolts are screwed into a lower-strength, e.g., bronze alloy, hub or blade flange. In this (conventional) configuration, many more bolts and/or multi-jack-bolt tensioners may be required, resulting in more machining and, in the case of multi-jack-bolt tensioners, a significant burden on the installer or maintainer to properly tension hundreds of small fasteners, in some cases from the inside of a space-constrained hub. The fixed bolted propeller 100 described in this disclosure may require fewer than ten bolts 122 per propeller blade 114, such as, for example, from six to eight bolts 122 per propeller blade 114. Advantageously, the bolted joint has excellent fatigue strength, and the cost and complexity of the propeller 100 are low. The fixed bolted propeller 100 may be successfully employed in high power density applications. Also, due to the entry of the bolts 122 from outside the hub 102, repair or servicing of the fixed-pitch bolted propeller 100 (e.g., for bolt inspection or blade change) may take place underwater without removing the hub end cover 128.

Figure 2B:
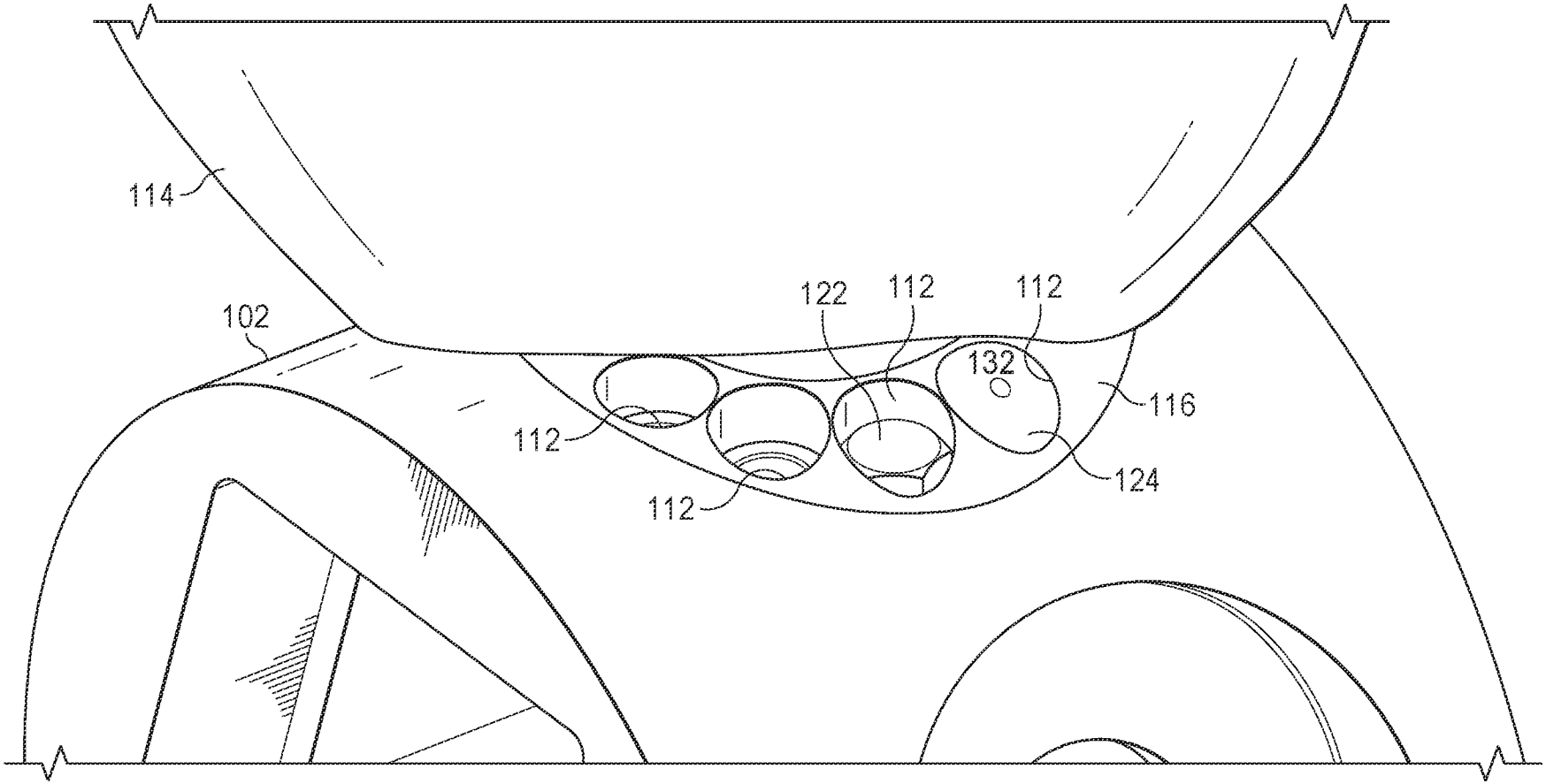
FIG. 2B shows a close-up view of an outer portion of the hub of the fixed-pitch bolted propeller, showing attachment of a blade flange at one of the connection ports.
Figure 2C:
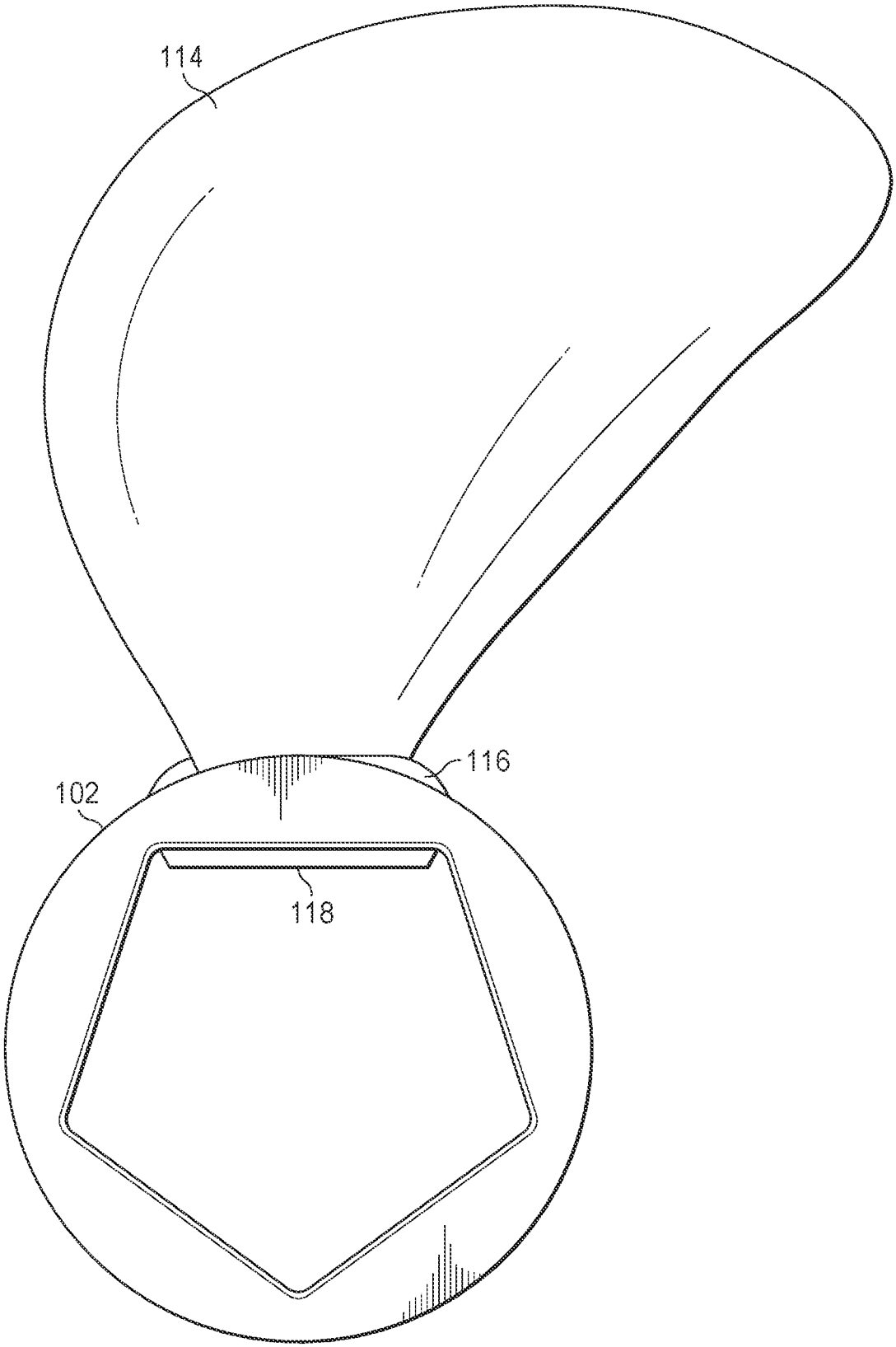
FIG. 2C shows a front view of a portion of the hub of the fixed-pitch bolted propeller.

Referring now to FIG. 2B, the bolt holes 112 in the blade flange 116 are sufficiently recessed such that heads of the bolts 122 (one is visible in this figure) lie below an outer surface 116*a* of the blade flange 116. Bolt covers 124 are positioned over the heads of the bolts 122, as shown for one of the bolt holes 112. To create a smooth flange surface and avoid turbulence, the top surface of each bolt cover 124 is shaped to match the contour of the outer surface of the respective blade flange 116, as illustrated. Accordingly, the outer surface of the blade flange 116 and the top surface of each bolt cover 124 have a hydrodynamically flush configuration that prevents or eliminates cavitation in use. To facilitate achieving the desired shape, the bolt covers 124 may be fabricated by 3D printing using a commercially available printer. Accordingly, the bolt covers 124 may be produced from a material capable of being 3D printed, such as a polymer, a reinforced polymer, a metal, and/or a metal alloy. Each bolt cover 124 may be retained in the blade flange 116 by means of a retention fastener 132 that is screwed into a receiving threaded hole in the head of the respective blade bolt 122. The retention fasteners 132 may be recessed within small holes in the bolt covers 124 and can be potted over with epoxy or another suitable marine sealant to preserve hydrodynamically fair and smooth surfaces.

The hollow hub body 102 and the propeller blades 114 may comprise a bronze alloy, such as a nickel aluminum bronze alloy, or stainless steel. The material of the bolts 122 may comprise a high-strength metal alloy which is also corrosion-resistant, such as a high strength stainless steel, a nickel alloy, or a cobalt alloy. Preferably, the high-strength metal alloy may be a nickel-chromium alloy (e.g., Inconel). The material of the retention plates 118 may comprise a high-strength steel, such as alloy steel forgings. In use, the connection ports 110 and the end cover 128 of the hub body 102 are sealed and the hub 102 may be filled with grease or lubricant to protect the interior, including the retention plates 118, from seawater. Also or alternatively, the fixed bolted propeller 100 may include a buoyancy module 130, e.g., comprising a closed cell foam, contained with the hollow hub body 102, as shown in FIG. 1B. The bolts 122, hub 102, blades 114 and integrally formed blade flange 116, and/or retention plates 118 may be fabricated by metal casting. The fixed bolted propeller 100 may be capable of operating at a torque density in excess of 60 in-lb/in$^3$ (or in excess of about 0.4 mm-N/mm$^3$) based on the hub maximum diameter.

Figure 3A:
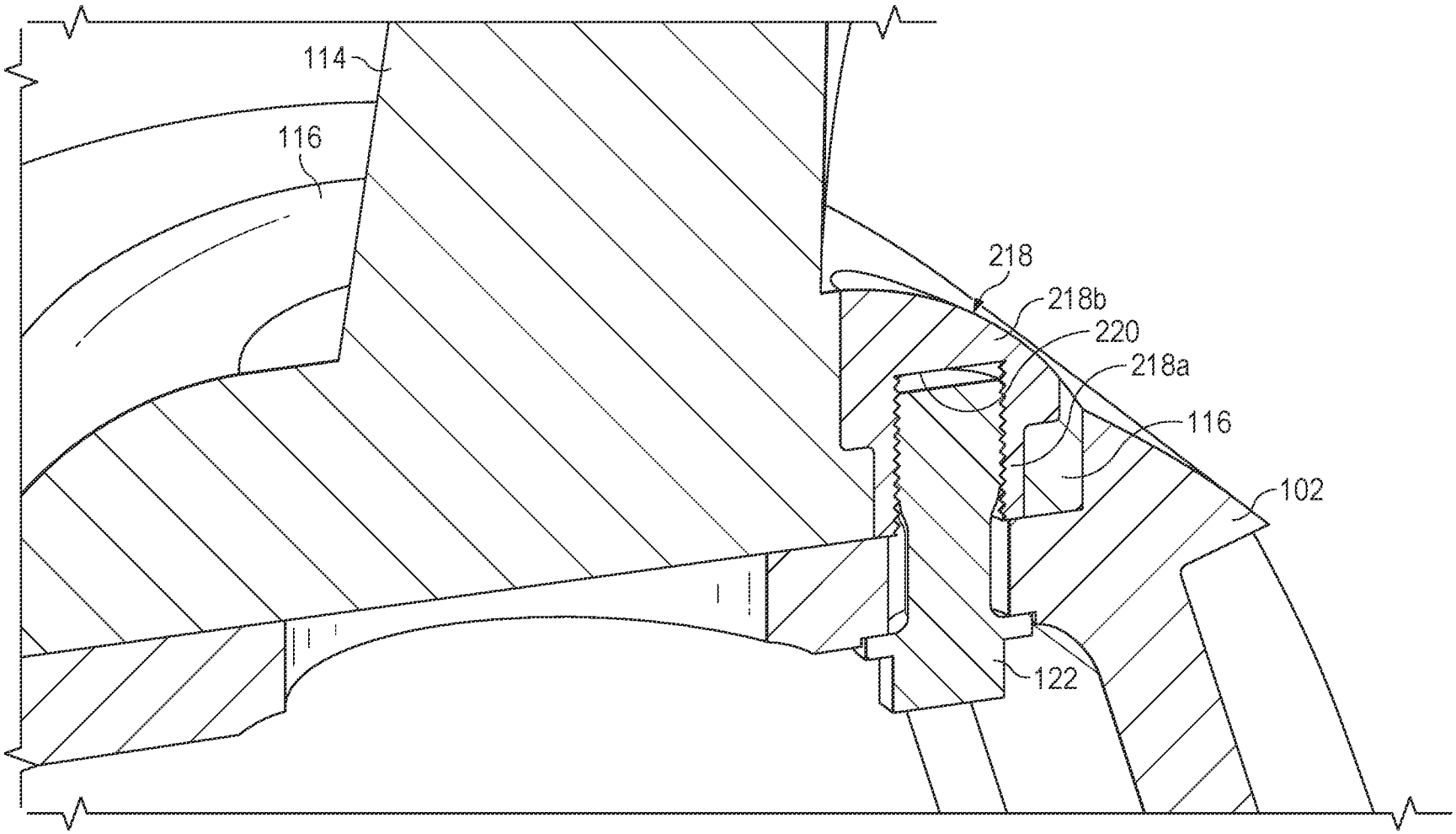
FIG. 3A shows a partial cross-sectional view of a portion a fixed-pitch bolted propeller including a threaded insert instead of the retention plate.
Figure 3B:
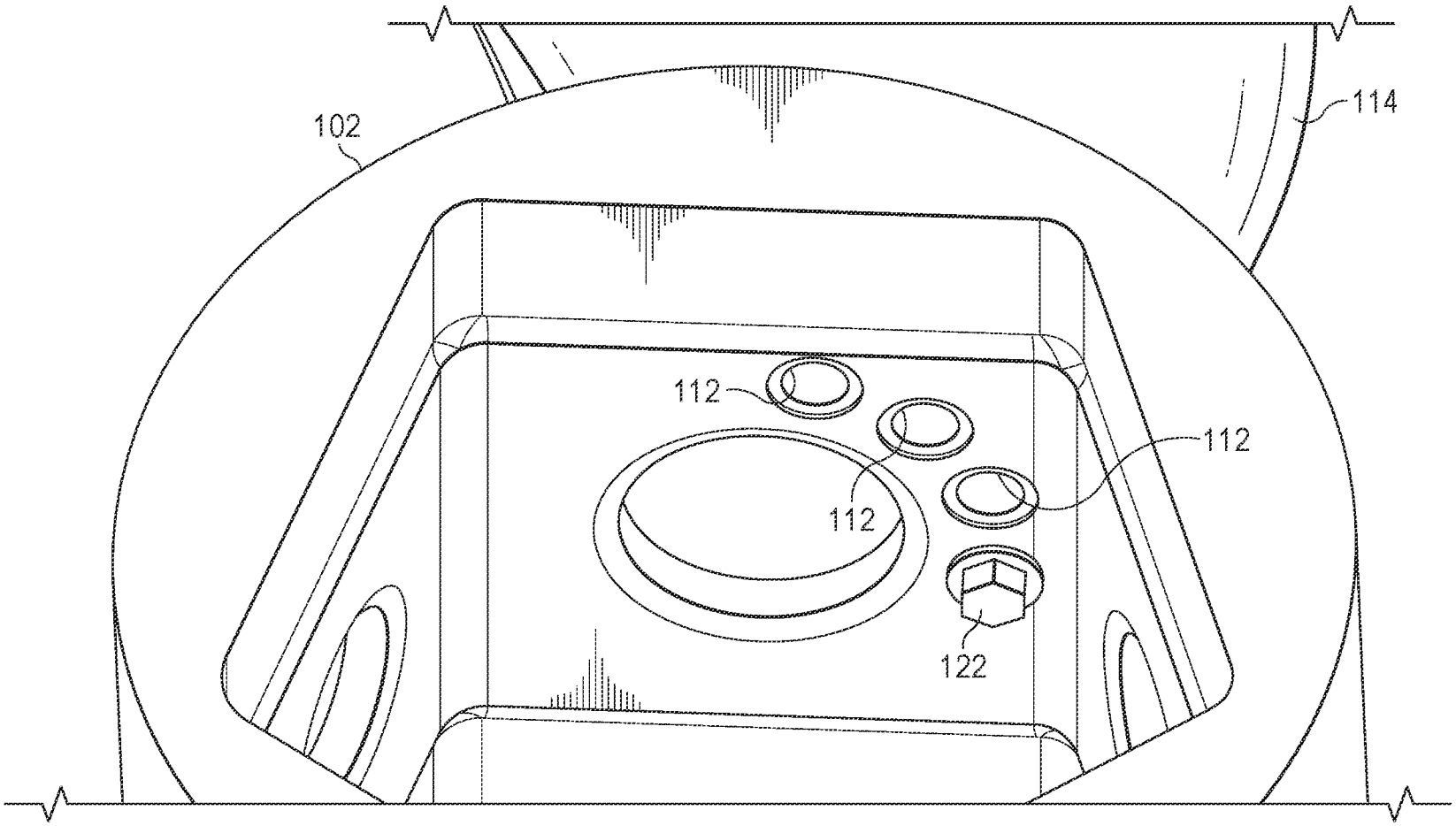
FIG. 3B shows a perspective view of an inner surface of the hub of the fixed-pitch bolted propeller of FIG. 3A.

FIGS. 3A and 3B show another embodiment of the fixed bolted propeller 100, where threaded inserts 218 are used in place of the retention plates 118, as explained below. As in the previous embodiment, the fixed bolted propeller 100 includes a hollow hub body (or "hub") 102 configured for attachment to a rotatable shaft 104, as shown in FIG. 1A. The hollow hub body 102 includes connection ports 110 circumferentially distributed on an outer surface of the hollow hub body 102, where each of the connection ports 110 includes bolt holes 112 that enable the hollow hub body 102 to be secured to propeller blades 114, as illustrated in FIG. 2A. The propeller blades 114 of the fixed bolted propeller 100 are circumferentially positioned about the hub, where each of the propeller blades 114 terminates in a blade flange 116 attached to the outer surface of the hollow hub body 102 at one of the connection ports 110, as described above in reference to FIG. 1B. To facilitate attachment of the propeller blades 114 to the hub, the blade flanges 116 include bolt holes 112 which are aligned with the bolt holes 112 of the connection ports 110. Five propeller blades 114 are shown in the figures; however, generally speaking the fixed bolted propeller 100 of either embodiment may include from three to six propeller blades 114, and consequently from three to six connection ports 110. The hollow hub body 102 may have a flanged first end 106 that can be attached to a flanged end 108 of the rotatable shaft 104 for use, for example, in a naval propulsion system. The fixed-pitch bolted propeller 100 may further comprise a hub end cover 128 secured to a flanged second end 126 of the hollow hub body 102.

Referring now to FIG. 3A, the fixed bolted propeller 100 may include, instead of the retention plates 118 of the first embodiment, threaded inserts 218 secured within the bolt holes 112 of the blade flanges 116. Each of the inserts 218 includes a threaded recess 220 configured to accept a bolt. A capped back end **218*b* of each threaded insert 218 is configured to match a contour of the outer surface of the blade flange 116 and a threaded end 218*a* is configured for entry of the bolt 122. Accordingly, the blade flange outer surface and the capped back end 218*b* have a hydrodynamically flush configuration that prevents or eliminates cavitation in use. In this embodiment, bolts 122 extend from an inner surface of the hollow hub body 102 through the bolt holes 112 of the connection ports 110 and into the threaded ends 218*a* of the inserts 218 to secure the propeller blades 114 to the hub, as shown in FIG. 3B. The threaded inserts 218 and the bolts 122 each comprise a material having a tensile strength of at least about 125 ksi (or at least about 862 MPa) and/or a fatigue endurance limit of at least about 50 ksi (or at least about 345 MPa). Use of the threaded inserts 218 in conjunction with high-strength bolts 122 avoids a configuration where the high-strength bolts are bolted into a lower-strength, e.g., bronze alloy, blade flange or hub. In this (conventional) configuration, many more bolts and/or multi-jack-bolt tensioners may be required, resulting in more machining and, in the case of multi-jack-bolt tensioners, a significant burden on the installer or maintainer to properly tension hundreds of small fasteners. The fixed bolted propeller 100 of this embodiment may require fewer than ten bolts 122 per propeller blade 114, such as, for example, from six to eight bolts 122 per propeller blade 114. Advantageously, the bolted joint has excellent fatigue strength, and the cost and complexity of the propeller 100 are low. The fixed bolted propeller 100** may be successfully employed in high power density applications.

As in the previous embodiment, the hollow hub body 102 and the propeller blades 114 may comprise a bronze alloy, such as a nickel aluminum bronze alloy, or stainless steel. The material of the bolts 122 may comprise a high-strength metal alloy, such as a high strength stainless steel, a nickel alloy, or a cobalt alloy. The material of the inserts 218 may comprise a high-strength steel/metal alloy, such as a nickel alloy which is preferably resistant to corrosion. In use, the connection ports 110 and the end cover 128 of the hub body 102 are sealed and the hub may be filled with grease or lubricant to protect the interior from seawater. Also or alternatively, the fixed bolted propeller 100 may include a buoyancy module 130, e.g., comprising a closed cell foam, contained with the hollow hub body 102. The bolts 122, hub 102, blades 114 and integrally formed blade flange 116, and/or inserts 218 may be fabricated by metal casting. The fixed-pitch bolted propeller 100 may be capable of operating at a torque density in excess of 60 in-lb/in$^3$ (or in excess of about 0.4 mm-N/mm$^3$) based on the hub maximum diameter.

To clarify the use of and to hereby provide notice to the public, the phrases "at least one of <A>, <B>, . . . and <N>" or "at least one of <A>, <B>, . . . or <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

A first aspect relates to a fixed-pitch bolted propeller comprising: a hollow hub body configured for attachment to a rotatable shaft, the hollow hub body including connection ports circumferentially distributed on an outer surface thereof; propeller blades, each of the propeller blades terminating in a blade flange attached to the outer surface of the hollow hub body at one of the connection ports; retention plates positioned on an inner surface of the hollow hub body adjacent to the connection ports, the retention plates including threaded recesses; and bolts extending through bolt holes in the blade flanges and the connection ports and into the threaded recesses of the retention plates to secure the propeller blades to the hollow hub body, wherein the retention plates and the bolts each comprise a material having a tensile strength of at least about 125 ksi and/or a fatigue endurance limit of at least about 50 ksi.

A second aspect relates to the fixed-pitch bolted propeller of the first aspect comprising from three to six of the connection ports.

A third aspect relates to the fixed-pitch bolted propeller of any preceding aspect comprising from six to eight of the bolts per propeller blade.

A fourth aspect relates to the fixed-pitch bolted propeller of any preceding aspect, wherein the bolt holes in the blade flange are sufficiently recessed such that heads of the bolts lie below the outer surface.

A fifth aspect relates to the fixed-pitch bolted propeller of any preceding aspect, further comprising bolt covers positioned over the heads of the bolts, a top surface of each bolt cover being shaped to match a contour of the outer surface.

A sixth aspect relates to the fixed-pitch bolted propeller of the preceding aspect, wherein the bolt covers are 3D printed.

A seventh aspect relates to the fixed-pitch bolted propeller of any preceding aspect, wherein the bolt covers comprise a polymer, a reinforced polymer, a metal, and/or a metal alloy.

An eighth aspect relates to the fixed-pitch bolted propeller of any preceding aspect, wherein the hollow hub body and the blade comprise a bronze alloy or stainless steel.

A ninth aspect relates to the fixed-pitch bolted propeller of any preceding aspect, wherein the material of the retention plate comprises a high-strength steel.

A tenth aspect relates to the fixed-pitch bolted propeller of any preceding aspect, wherein the material of the bolts comprises a corrosion-resistant metal alloy.

An eleventh aspect relates to the fixed-pitch bolted propeller of the preceding aspect, wherein the corrosion-resistant metal alloy comprises a nickel-chromium alloy.

A twelfth aspect relates to the fixed-pitch bolted propeller of any preceding aspect, further comprising a hub end cover secured to a flanged second end of the hollow hub body.

A thirteenth aspect relates to the fixed-pitch bolted propeller of any preceding aspect, wherein the hollow hub body comprises a flanged first end for attachment to a flanged end of the rotatable shaft.

A fourteenth aspect relates to the fixed-pitch bolted propeller of any preceding aspect, further comprising a buoyancy module contained with the hollow hub body.

A fifteenth aspect relates to the fixed-pitch bolted propeller of the preceding aspect, wherein the buoyancy module comprises a closed cell foam.

A sixteenth aspect relates to the fixed-pitch bolted propeller of any preceding aspect comprising a torque density of at least about 60 in-lb/in$^3$ based on hub diameter.

A seventeenth aspect relates to a fixed-pitch bolted propeller including: a hub comprising a hollow hub body configured for attachment to a rotatable shaft, the hollow hub body including connection ports circumferentially distributed on an outer surface of the hollow hub body; propeller blades, each of the propeller blades terminating in a blade flange attached to the outer surface of the hollow hub body at one of the connection ports; threaded inserts secured in bolt holes of the blade flanges, each of the threaded inserts having a capped end configured to match a contour of an outer surface of the blade flange and a threaded end configured to receive a bolt; and bolts extending from an inner surface of the hollow hub body through bolt holes of the connection ports and into the threaded ends of the threaded inserts to secure the propeller blades to the hub, wherein the threaded inserts and the bolts each comprise a material having a tensile strength of at least about 125 ksi and/or a fatigue endurance limit of at least about 50 ksi.

An eighteenth aspect relates to the fixed-pitch bolted propeller of the seventeenth aspect comprising from six to eight of the bolts per propeller blade.

A nineteenth aspect relates to the fixed-pitch bolted propeller of the seventeenth or eighteenth aspects, wherein the hollow hub body and the propeller blades comprise a bronze alloy or stainless steel.

A twentieth aspect relates to the fixed-pitch bolted propeller of any of the seventeenth through nineteenth aspects, wherein the material of the threaded inserts and/or the material of the bolts comprises a high strength stainless steel or a nickel alloy.

A twenty-first aspect relates to the fixed-pitch bolted propeller of any of the seventeenth through the twentieth aspects, comprising a torque density of at least about 60 in-lb/in$^3$ based on hub diameter In addition to the features mentioned in each of the independent aspects enumerated above, some examples may show, alone or in combination, the optional features mentioned in the dependent aspects and/or as disclosed in the description above and shown in the figures.

What is claimed is:

1. A fixed-pitch bolted propeller comprising:

a hollow hub body configured for attachment to a rotatable shaft, the hollow hub body including connection ports circumferentially distributed on an outer surface thereof;

propeller blades, each of the propeller blades terminating in a blade flange attached to the outer surface of the hollow hub body at one of the connection ports;

retention plates positioned on an inner surface of the hollow hub body adjacent to the connection ports, the retention plates including threaded recesses; and bolts extending through bolt holes in the blade flanges and the connection ports and into the threaded recesses of the retention plates to secure the propeller blades to the hollow hub body, wherein, while the bolts are secured in the threaded recesses, the propeller blades have a fixed pitch relative to the hollow hub body, and wherein the retention plates and the bolts each comprise a material having a tensile strength of at least 125 ksi and/or a fatigue endurance limit of at least 50 ksi.

2. The fixed-pitch bolted propeller of claim 1 comprising from three to six of the connection ports.

3. The fixed-pitch bolted propeller of claim 1 comprising from six to eight of the bolts per propeller blade.

4. The fixed-pitch bolted propeller of claim 1, wherein the bolt holes in the blade flange are sufficiently recessed such that heads of the bolts lie below the outer surface.

5. The fixed-pitch bolted propeller of claim 4, further comprising bolt covers positioned over the heads of the bolts, a top surface of each bolt cover being shaped to match a contour of the outer surface.

6. The fixed-pitch bolted propeller of claim 5, wherein the bolt covers are 3D printed.

7. The fixed-pitch bolted propeller of claim 5, wherein the bolt covers comprise a polymer, a reinforced polymer, a metal, and/or a metal alloy.

8. The fixed-pitch bolted propeller of claim 1, wherein the hollow hub body and the blade comprise a bronze alloy or stainless steel.

9. The fixed-pitch bolted propeller of claim 1, wherein the material of the retention plate comprises a high-strength steel.

10. The fixed-pitch bolted propeller of claim 1, wherein the material of the bolts comprises a corrosion-resistant metal alloy.

11. The fixed-pitch bolted propeller of claim 10, wherein the corrosion-resistant metal alloy comprises a nickel-chromium alloy.

12. The fixed-pitch bolted propeller of claim 1, further comprising a hub end cover secured to a flanged second end of the hollow hub body.

13. The fixed-pitch bolted propeller of claim 1, wherein the hollow hub body comprises a flanged first end for attachment to a flanged end of the rotatable shaft.

14. The fixed-pitch bolted propeller of claim 1, further comprising a buoyancy module contained with the hollow hub body.

15. The fixed-pitch bolted propeller of claim 14, wherein the buoyancy module comprises a closed cell foam.

16. The fixed-pitch bolted propeller of claim 1 comprising a torque density of at least about 60 in-lb/in$^3$ based on hub diameter.

17. The fixed-pitch bolted propeller of claim 1, wherein each of the retention plates has a flat underside facing an interior of the hollow hub body.

18. A fixed-pitch bolted propeller comprising:

a hub comprising a hollow hub body configured for attachment to a rotatable shaft, the hollow hub body including connection ports circumferentially distributed on an outer surface of the hollow hub body;

propeller blades, each of the propeller blades terminating in a blade flange attached to the outer surface of the hollow hub body at one of the connection ports;

threaded inserts secured in bolt holes of the blade flanges, each of the threaded inserts having a capped end configured to match a contour of an outer surface of the blade flange and a threaded end configured to receive a bolt; and bolts extending from an inner surface of the hollow hub body through bolt holes of the connection ports and into the threaded ends of the threaded inserts to secure the propeller blades to the hollow hub body, wherein the threaded inserts and the bolts each comprise a material having a tensile strength of at least 125 ksi and/or a fatigue endurance limit of at least 50 ksi.

19. The fixed-pitch bolted propeller of claim 18 comprising from six to eight of the bolts per propeller blade.

20. The fixed-pitch bolted propeller of claim 18, wherein the material of the threaded inserts and/or the material of the bolts comprises a high strength stainless steel or a nickel alloy.

21. The fixed-pitch bolted propeller of claim 18 comprising a torque density of at least about 60 in-lb/in$^3$ based on hub diameter.

22. The fixed-pitch bolted propeller of claim 18, wherein, while the bolts are secured in the threaded inserts, the propeller blades have a fixed pitch relative to the hollow hub body.

* * * * *